US007976904B2

(12) United States Patent
Barcock et al.

(10) Patent No.: US 7,976,904 B2
(45) Date of Patent: Jul. 12, 2011

(54) CURTAIN COATING PROCESS USING A HIGH SOLIDS CONTENT COMPOSITION, AND COATED PRODUCT

(75) Inventors: Richard A. Barcock, Aylesbury (GB); Andrew Ward-Askey, Slough (GB)

(73) Assignee: Arjo Wiggins Fine Papers Limited, Buckinghamshire (GB)

( * ) Notice: Subject to any disclaimer, the term of this patent is extended or adjusted under 35 U.S.C. 154(b) by 667 days.

(21) Appl. No.: 11/658,818

(22) PCT Filed: Jul. 27, 2005

(86) PCT No.: PCT/GB2005/002947

§ 371 (c)(1), (2), (4) Date: Jan. 26, 2007

(87) PCT Pub. No.: WO2006/010927

PCT Pub. Date: Feb. 2, 2006

(65) Prior Publication Data

US 2008/0317963 A1 Dec. 25, 2008

(30) Foreign Application Priority Data

Jul. 29, 2004 (GB) ..... 0416900.9

(51) Int. Cl.
*B05D 1/30* (2006.01)

(52) U.S. Cl. ..... 427/420; 427/424; 427/425; 427/427

(58) Field of Classification Search ..... 427/420, 427/424, 425, 427

See application file for complete search history.

(56) References Cited

U.S. PATENT DOCUMENTS

| | | | | |
|---|---|---|---|---|
| 3,867,901 | A * | 2/1975 | Greiller | 118/50 |
| 5,206,057 | A * | 4/1993 | Finnicum et al. | 427/420 |
| 5,391,401 | A | 2/1995 | Blake et al. | |
| 5,393,571 | A | 2/1995 | Suga et al. | |
| 5,643,992 | A * | 7/1997 | Northey | 524/501 |
| 5,725,648 | A | 3/1998 | Brown et al. | |
| 6,099,913 | A | 8/2000 | Clarke et al. | |
| 2002/0160121 | A1 * | 10/2002 | Katagiri et al. | 427/420 |
| 2002/0192382 | A1 * | 12/2002 | Clarke et al. | 427/356 |
| 2003/0064162 | A1 * | 4/2003 | Clarke et al. | 427/420 |
| 2003/0113572 | A1 * | 6/2003 | Deodhar et al. | 428/537.5 |
| 2003/0170405 | A1 * | 9/2003 | Parrinello et al. | 428/32.11 |
| 2004/0106716 | A1 | 6/2004 | Becker et al. | |

OTHER PUBLICATIONS

International Search Report corresponding to International Application No. PCT/GB2005/002947.

BASF AG, "Surfactants and polyalkylene glycols", Jan. 2005.

* cited by examiner

*Primary Examiner* — Shamim Ahmed

(74) *Attorney, Agent, or Firm* — Fay Sharpe LLP

(57) ABSTRACT

The invention relates to a curtain coating process for coating substrates with a stable curtain and a uniform coating at low flow rates wherein a free-falling curtain of an aqueous composition comprising a high solids content is coated onto the moving substrate at a flow rate per unit die length value (Q) equal to or inferior to $10^{-4}$ $m^3/(s \cdot m)$, the said high solids content composition comprising a polymeric rheology modifier and a non-ionic surfactant. The invention relates in particular to a curtain coating process for coating fibrous substrates such as paper or board. The invention also relates to a coated product.

22 Claims, No Drawings

CURTAIN COATING PROCESS USING A HIGH SOLIDS CONTENT COMPOSITION, AND COATED PRODUCT

This application is the U.S. National Phase under 35 U.S.C. §371 of International Application PCT/GB2005/002947, filed Jul. 27, 2005, published in English, which claims priority to Great Britain Patent Application No. 0416900.9, filed Jul. 29, 2004. The contents of these applications are incorporated herein by reference in their entireties.

FIELD OF INVENTION

The invention relates to a curtain coating process using a high solids content composition for coating a substrate web, and to a coated product.

BACKGROUND OF THE INVENTION

In the manufacture of printing paper, pigmented coating compositions are applied by, for example, blade, bar, air-knife or reverse-roll type coating methods, usually at high speeds. However, the said coating methods are non-contoured (with the exception of air-knife coating method) onto rough substrates which means that any irregular substrate surface will lead to non-uniform coating thickness, which may result in irregularities during the printing process.

Curtain coating methods are now being developed in the paper industry for coating paper webs, to achieve uniformity in surface application which is a necessary condition for obtaining a good final print rendering.

Curtain coating processes are well known and widely used for the application of one or more liquid layers onto the surface of a moving support in the photographic industry. Indeed, this technology was developed for photographic films that require the deposit of many different coats, usually between 8 and 10, with severe constraints on the surface condition and also the thickness of applied coats.

Curtain coating is a pre-metered coating process which means that only the required amount of coating liquid needed on the web is pumped through the coating head. The curtain coating process is based on free flow on a surface from a coating head located above the surface to be coated. The support is coated by forming a freely-falling vertical curtain of liquid so that it impinges onto the support. A controlled relationship is maintained between the flow rate of the liquid and the speed at which the support is moved so that the curtain is stable and has a uniform flow rate across its width to obtain a layer of the coating onto the substrate. The coating head is defined using properties of the coating fluid, so as to obtain the most uniform possible coating film, thickness in the running direction or the transverse direction of the machine.

One of the advantages of curtain coating is the superior quality and more uniform surface of the substrates, namely paper webs, that can be attained.

Another advantage is the lack of contact between the coating head and the support, unlike contact coating processes such as blade and rod coating. This provides a means of eliminating forces applied on the support during coating, which causes web breakage in particular, and can have a non-negligible effect on the increase in the machine speed, and consequently can reduce production costs.

Another advantage of curtain coating is the possibility of applying two or more coats simultaneously.

Despite many attempts to coat substrate webs with one or more coating layers using curtain coating processes, the main limiting factors to curtain coating remain the curtain stability and the air entrainment, which gives rise to the inclusion of air between the coating composition and the web leading to numerous bubbles and irregularities in the coating. Puddling of the curtain can also be an issue and lead to the formation of a heel at the curtain impingement zone, usually as a result of the coating fluid being too low in viscosity. This phenomenon can lead to coating non-uniformities, and can also induce air entrainment at relatively low web speeds. Highly viscous and elastic curtains tend to 'pull' along the web, which can also lead to a non-uniform coating due to fluctuations at the curtain impingementzone. In curtain coating, uniform layer(s) are only obtained if the operational variables are held within fairly precise limits. These limits define the coating 'window'. One example is air entrainment, as described in U.S. Pat. No. 5,391,401 (Blake et al.). This patent describes a method to alleviate the issues of air entrainment. Therein is described an optimum relationship between viscosity and shear rate for curtain coating. The desired rheological profile promotes a low viscosity at the shear rates expected near the dynamic wetting line, where the coating wets the substrate, and a high viscosity at the much lower shear rates expected in the other regions of the flow. Coating composition can be increased in viscosity by the addition of thickening agents that interact with the binder, which has the effect of increasing the mix viscosity at low shear rate without substantially raising its viscosity at high shear rate, implying that a high viscosity at high shear rate is a disadvantage. Much of this work has been recorded for formulation containing binder, especially gelatine, along with silver halide grains for use in photographic applications. U.S. Pat. No. 5,393,571 (Suga et al.) describes the alleviation of air entrainment and puddling of the curtain coating by using a mix of viscosity superior to 90 mPa·s at low shear rate (10 $s^{-1}$) onto a rough surface (0.3 μm). U.S. Pat. No. 6,099,913 (Clarke et al.) describes the formation of a coated layer adjacent to the substrate surface having a viscosity of 90 mPa·s to 220 mPa·s at a shear rate of 10000 $s^{-1}$, which can form a free-falling curtain and allows for higher coating speeds to be attained without air entrainment. These applications are apparently suitable for photographic formulations generally containing gelatine and silver halide grains, which typically have a low solids content.

A second example of a limiting factor is curtain stability which is related to the ratio of inertial to surface tension forces (Weber number). This implies that higher flow rates and lower surface tensions are beneficial to curtain stability. However, in certain cases high flow rates are undesirable especially when high solid content mixes are used and lower coat weights are required.

Many typical paper coating compositions are highly pigmented and of high solids content and inherently are shear-thinning (pseudo-plastic) in nature. This type of rheology is useful for applications with blade, bar, reverse roll, slot or slide coating techniques. However, it has been observed that numerous pigmented paper coating formulations do not form a stable curtain at low flow rates (especially when Q, the flow rate per unit die length, is equal to or less than $10^{-4}$ $m^3/(s \cdot m)$ for aqueous systems).

If the curtain coating method is to be used to coat high solid content paper formulations at low coat weights, this can only be achieved currently by utilising faster web speeds. However, at faster web speeds air entrainment becomes a real issue especially when coating onto smooth, less porous substrates.

Diluting the mix in order to run at slower web speeds is not an option. High solids mixes are preferred in the coating process as there is less demand on the drying capacity and it allows for lower grammage raw base (<80 $g/m^2$) to be used, which can readily break during the process under high wet coating weights. Higher solid content mixes impart improved properties on the coated media, for example, higher gloss. Diluting mixes also lowers mix viscosity, which can lead to heel formation at the curtain impingement zone, if it becomes too low.

INVENTION

Thus, there is a requirement to generate coating formulations which can generate a stable curtain under low flow rates.

Described herein is an improved coating process for pigmented coatings which allows the coating 'window', including the curtain stability and coating uniformity, to be expanded. This means that the coating process can be run at a wider range of web speeds, reduced flow rates and, thus, lower corresponding wet lay down and dry coat weight, without destabilising the curtain. A further option allowed is the ability to coat onto smoother, coated substrates, which tend to give rise to the onset of air entrainment more readily than rougher substrates as the web speed is increased. This offers a greater flexibility with the entire coating process and allows for a greater success in producing high quality coated substrates such as paper, board and plastic webs.

This is achieved by the combined addition of a small quantity of a polymeric additive (rheology modifier) and a non-ionic surfactant to the aqueous coating composition. The former (i.e. rheology modifier) increases the viscosity of the coating composition under mid to high shear rates, and the latter (i.e. non-ionic surfactant) lowers the surface tension of the coating composition. Extensional viscosity was influenced by the choice and quantity of rheology modifier.

The rheology modifier additives include anionic polyacrylamide/acrylate polymers and ionic hydrophobic polyether types. The advantage of these polymeric additives is that they can be added to the formulation in small quantities (<2% dry weight) with no detrimental impact on the product properties (gloss, opacity, colorimetric coordinates L*a*b*, stiffness, smoothness) or on print performance (image quality, optical density, dry time). The surfactants are preferably selected among non-ionic surfactants.

The combination of surfactant and rheology modifier seems to have a significant influence upon extending the curtain coating 'window' of operation. There were no signs that the increase in mid to high shear rate viscosity due to the presence of the rheology modifiers had any influence on the onset of air-entrainment or puddling at the coating impingement zone.

The invention provides a process of producing a free-falling curtain of an aqueous pigmented composition having a high solids content at a flow rate per unit die length values (Q) equal to or inferior to $1\times10\ m^3/(s\cdot m)$ for coating onto a moving web.

The said composition contains a surfactant (which lowers the surface tension of the composition) and a polymeric rheology modifier.

More particularly, the invention provides a curtain coating process for coating a substrate with a stable curtain and a uniform coating at low flow rates wherein a free-falling curtain of an aqueous composition comprising a high solids content is coated onto a moving substrate at a flow rate per unit die length value (Q) equal to or inferior to $1\times10^{-4}\ m^3/(s\cdot m)$, the said high solids content composition comprising a polymeric rheology modifier and a non-ionic surfactant.

The said rheology modifier is selected from the group comprising water phase thickeners and associative thickeners, or a combination of the two.

The said surfactant is selected from the group of alkyl aryl ethoxylates, alkoxylated acetylenics, alkyl acetylenic diols, non-alkoxylated acetylenics, secondary alcohol alkoxylates, and mixtures thereof.

The said composition comprises binders and coating pigments. In particular, the binder is selected from a group consisting of copolymers of styrene, in particular styrene-butadienes or styrene-acrylates, styrene-maleic anhydrides, polyvinyl alcohols, polyvinyl pyrrolidones, carboxymethyl celluloses, starches, proteins, polyvinyl acetates, polyurethanes, polyesters, and mixtures thereof.

Preferably, the pigments are selected from calcium carbonates, kaolin, talc, titanium dioxide, silica, alumina, boehmite alumina, barium sulphate, zinc oxide, conductive pigments, aluminium silicate, and mixtures thereof.

The said aqueous composition has a high solids content more than or equal to 50% in dry weight, preferably more than 60%.

The concentration of the said rheology modifier in the composition is less than 5% dry weight and preferably less than 1% dry weight, more preferably less than 0.5% dry weight of the total composition dry weight.

The concentration of the said surfactant in the composition is less than 1% dry weight and preferably less than 0.5% dry weight, more preferably less than 0.3% dry weight of the total composition dry weight.

Preferably the viscosity of the said aqueous composition is between 50 and 200 mPa·s at a shear rate of $1000\ s^{-1}$, between 25 and 90 mPa·s at a shear rate of $10000\ s^{-1}$, and between 20 and 75 mPa·s at a shear rate of $100\ 000\ s^{-1}$, all sets of data recorded at 25° C.

Preferably, the static surface tension of the aqueous composition is less than 45 mN/m.

Preferably, the dry coat weight coated onto the substrate is less than or equal to 12 $g/m^2$, preferably less than or equal to 10 $g/m^2$.

According to the invention, the substrate is either a fibrous substrate such as a paper or a board, or a plastic web.

Preferably, the curtain is coated onto a continuous paper web substrate which is either a) non-coated or primed, b) pre-coated or pre-primed, c) pre-coated and subsequently calendered.

In particular, when the substrate is a paper substrate, the grammage of the said paper substrate before coating is less than or equal to 150 $g/m^2$, more particularly less than or equal to 80 $g/m^2$.

The free-falling curtain is comprised of one or more layers.

According to a particular embodiment of the invention, the free-falling curtain is Comprised of two layers of aqueous composition with a high solids content as above described.

According to another aspect of the invention there is provided a coated product including a substrate and a substantially uniform coating on the substrate, the coating comprising a high solids content composition including a polymeric rheology modifier and anon-ionic surfactant.

The invention provides a paper or plastic support (web or sheet) obtained from this process, in particular a high gloss paper.

EXAMPLES

Examples of rheology modifiers utilised are outlined in Table 1 and examples of surfactants utilised are outlined in Table 2.

TABLE 1

| Rheology Modifier | Company | Polymer Type | Mode of Activity | Major Feature |
|---|---|---|---|---|
| Sterocoll BL | BASF | Anionic water-in-oil emulsion of an acrylamide-acrylic acid copolymer | Water phase thickener | Mid-shear rate viscosity-build. Extensional viscosity build |
| Rheolate 212 | Elementis | Hydrophobic ethoxylated polyurethane | Associative thickener | High-shear rate viscosity-build |
| Rheolate 350 | Elementis | Polyether polyol | Associative thickener | High-shear rate viscosity-build |
| Rheolate 425 | Elementis | Hydrophobic modified alkali swellable polyacrylate | Water phase/ Associative thickener | Low/mid-shear rate viscosity-build |
| Rheovis 802 | CIBA | Anionic polyacrylamide/ acrylate | Water phase thickener | High/mid shear rate viscosity-build |
| Mowiol 40-88 | Kuraray | Polyvinyl alcohol | Water phase thickener | High/mid shear rate viscosity-build. Extensional viscosity build |

TABLE 2

| Surfactant | Company | Molecule Type |
|---|---|---|
| Surfynol CT211 | Air Products | Alkyl acetylenic diol |
| Surfynol 420 | Air Products | Ethoxylated acetylenic |
| Surfynol 2502 | Air Products | Ethoxylated/Propoxylated acetylenic |
| Surfynol 485 | Air Products | Ethoxylated acetylenic |
| Dynol 604 | Air Products | Non-ethoxylated acetylenic |
| Tergitol 15-S-7 | DOW | Secondary alcohol ethoxylate |
| Tergitol 15-S-9 | DOW | Secondary alcohol ethoxylate |
| Tergitol TMN6 | DOW | Branched secondary alcohol ethoxylate |
| Triton X100 | DOW | Octylphenol ethoxylate |
| Dapro W77 | Elementis Specialities | Ethoxylated fatty acid ester |

Substrate 150 g/m$^2$ clay-coated substrate composing of 130 g/m$^2$ raw paper base with 20 g/m$^2$ clay coating calendered at $10^5$N/m using a 2-nip steel roller calender stack at 600 m/min. The physical properties of the coated paper substrate are shown in Table 3.

TABLE 3

| Parameter | Value |
|---|---|
| Total Surface Energy (Dyne/cm) | 41.4 |
| Contact Angle (°) water | 81.7 |
| Contact Angle (°) bromonaphthalene | 29.8 |
| Bekk Smoothness (sec) | 4135 |
| Bendtsen Air Permeability (mL/min) | 0 |
| Gloss (75°) (%) | 24.7 |

EXAMPLES

Example 1 (Comparative)

Calcium carbonate pigments (85 parts) were dispersed in water. A latex binder (15 parts) was added to the formulation and the mix was allowed to stir for 0.5 h. The solids content of the formulation was recorded at 64.7%.

Example 2 (Comparative)

Calcium carbonate pigments (84.8 parts) were dispersed in water. A latex binder (14.97 parts) was added to the formulation and the mix was allowed to stir for 0.5 h. Surfynol CT211 (0.23 parts) was added to the mix and allowed to stir for a further 0.5 h. The solids content of the formulation was recorded at 65.5%.

Example 3 (Invention)

Calcium carbonate pigments (84.62 parts) were dispersed in water. A latex binder (14.94 parts) was added to the formulation and the mix was allowed to stir for 0.5 h. Surfynol CT211 (Air Products) (0.23 parts) was added to the mix and allowed to stir for a further 0.5 h. 0.21 parts of Sterocoll BL (BASF) was added at the end of the formulation. The mix was stirred for a further 0.5 h. The solids content of the formulation was recorded at 65.08%.

Example 4 (Invention)

Calcium carbonate pigments (84.44 parts) were dispersed in water. A latex binder (14.90 parts) was added to the formulation and the mix was allowed to stir for 0.5 h. Surfynol CT211 (0.23 parts) was added to the mix and allowed to stir for a further 0.5 h. 0.42 parts of Rheovis 802 (CIBA) was added at the end of the formulation. The mix was stirred for a further 0.5 h. The solids content of the formulation was recorded at 65.0%.

Example 5 (Invention)

Calcium carbonate pigments (84.44 parts) were dispersed in water. A latex binder (14.9 parts) was added to the formulation and the mix was allowed to stir for 0.5 h. Surfynol CT211 (0.23 parts) was added to the mix and allowed to stir for a further 0.5 h. 0.42 parts of Mowiol 40-88 (Kuraray) was added at the end of the formulation. The mix was stirred for a further 0.5 h. The solids content of the formulation was recorded at 63.5%.

Example 6 (Invention)

Calcium carbonate pigments (90.52 parts) were dispersed in water. A latex binder (8.42 parts) was added to the formulation and the mix was stirred. Surfynol CT211 (0.27 parts) was added to the mix. 0.03 parts of a defoamer was added to the mix, followed by the addition of 0.41 parts of Mowiol 4-98 (as a rheology modifier) (Kuraray) and 0.05 parts of Sterocoll BL (BASF), agitation was performed between each component addition. The mix pH was adjusted to 10.3 with sodium hydroxide.

The solids content of the formulation was recorded at 65.5%.

Results and Discussion

Example 1 did not contain either the surfactant or rheology modifier and a curtain could only be formed at a Q (flow rate per unit die length) value of $1.8\times10^{-4}$ m$^3$/(s·m). The static surface tension was measured at 45 mN/m. At a web speed of 400 m/min this corresponded to a dry coat weight of 26.6 g/m$^2$ which is far greater than the coat weight requirement of <10 g/m$^2$ for coated paper of good quality (image quality and dry time) for off-set printing. However, the coating was unstable at the impingement zone, possible due to air entrainment, and a poor coating uniformity was obtained. The viscosity of the mix at a shear rate of 100 s$^{-1}$ was 125 mPa·s, at a shear rate of 1000 s$^{-1}$ was 37 mPa·s, at a shear rate of 10.000 s$^{-1}$ was 14 mPa·s, and at a shear rate of 100 000 s$^{-1}$ was 13 mPa·s.

Example 2 involved the addition of the non-ionic surfactant to Example 1 which allowed for the curtain to form at a much reduced flow-rate per unit die length ($Q=9.26\times10^{-5}$ $m^3/(s\cdot m)$), in comparison to Example 1. This is due to the lowering of the surface tension of the mix to 35 mN/m. This allows for a dry coat weight of 14.0 $g/m^2$ to be attained, which is much lower than in the absence of surfactant but higher than the target 10 $g/m^2$. The viscosity of the mix at a shear rate of 100 $s^{-1}$ was 142 mPa·s, at a shear rate of 1000 $s^{-1}$ was 43 mPa·s, at a shear rate of 10 000 $s^{-1}$ was 18 mPa·s, and at a shear rate of 100 000 $s^{-1}$ was 18 mPa·s.

Example 3 involved the addition of the surfactant and rheology modifier (Sterocoll BL) to Example 1, which yielded a stable curtain at a flow rate per unit die length, Q, of $6.73\times10^{-5}$ $m^3/(s\cdot m)$. This yielded a dry coat weight of 9.4 $g/m^2$ which was within the target required. The static surface tension is increased over Example 1 (rheology modifiers tend to raise the surface tension), to 40 mN/m. However, the flow rate required for curtain stability is lower than that in Example 1. A uniform coating profile was obtained until a speed of 600 m/min was reached, where the onset of air entrainment occurred. The viscosity of the mix at a shear rate of 100 $s^{-1}$ was 438 mPa·s, at a shear rate of 1000 $s^{-1}$ was 107 mPa·s, at a shear rate of 10 000 $s^{-1}$ was 50 mPa·s, and at a shear rate of 100 000 $s^{-1}$ was 48 mPa·s.

Example 4 involved the addition of the surfactant and rheology modifier (Rheovis 802) to Example 1, which yielded a stable curtain at a flow rate per unit die length, Q, of $6.17\times10^{-5}$ $m^3/(s\cdot m)$. This yielded a dry coat weight of 8.5 $g/m^2$ which was within the target required. The static surface tension is increased over Example 1 (rheology modifiers tend to raise the surface tension), to 37 mN/m. However, the flow rate required for curtain stability is again lower than that in Example 1. A uniform coating profile was obtained until a speed of 600 m/min was reached, where the onset of air entrainment occurred. The viscosity of the mix at a shear rate of 100 $s^{-1}$ was 355 mPa·s, at a shear rate of 1000 $s^{-1}$ was 80 mPa·s, at a shear rate of 10 000 $s^{-1}$ was 28 mPa·s, and at a shear rate of 100 000 $s^{-1}$ was 24 mPa·s.

Example 5 involved the addition of the surfactant and Mowiol 40-88 polyvinyl alcohol to Example 1, which yielded a stable curtain at a flow rate per unit die length, Q, of $7.86\times10^{-5}$ $m^3/(s\cdot m)$. This yielded a dry coat weight of 10.0 $g/m^2$ which was within the target required. The static surface tension is increased over Example 1 to 42 mN/m. However, the flow rate required for curtain stability is lower than in Example 1. A uniform coating profile was obtained until a speed of 600 m/min was reached, where the onset of air entrainment occurred. The viscosity of the mix at a shear rate of 100 $s^{-1}$ was 161 mPa·s, at a shear rate of 1000 $s^{-1}$ was 124 mPa·s, at a shear rate of 10 000 $s^{-1}$ was 77 mPa·s, and at a shear rate of 100 000 $s^{-1}$ was 34 mPa·s.

Example 6 involved the addition of the surfactant and a dual rheology modifier system (Sterocoll BL+Mowiol 4-98) to a latex binder and calcium carbonate coating mix. A stable curtain at a flow rate per unit die length Q of $9.45\times10^{-5}$ $m^3/(s\cdot m)$ was formed and the static surface tension value was of 35.5 mN/m. A uniform coating profile was obtained without air entrainment at a line speed of 600 m/min. The coated paper obtained presents good print performance. The dry coat weight was of 10.0 $g/m^2$. The viscosity of the mix at a shear rate of 100 $s^{-1}$ was 255 mPa·s, at a shear rate of 1000 $s^{-1}$ was 78 mPa·s, at a shear rate of 10.000 $s^{-1}$ was 37 mPa·s, and at a shear rate of 100 000 $s^{-1}$ was 29 mPa·s.

Viscosity results at the various shear rates for each mix are summarised in Table 4.

TABLE 4

| Example No. | Surfactant Present | Rheology Modifier/ % dry parts | Shear Rate ($s^{-1}$) 10 | 100 | 1 000 | 10 000 | 100 000 |
|---|---|---|---|---|---|---|---|
| 1 | none | none | 442 | 125 | 37 | 14 | 13 |
| 2 | yes | none | 544 | 142 | 43 | 18 | 18 |
| 3 | yes | 0.21% Sterocoll BL | 2411 | 438 | 107 | 50 | 48 |
| 4 | yes | 0.42% Rheovis 802 | 1914 | 355 | 80 | 28 | 24 |
| 5 | yes | 0.42% Mowiol 40-88 | 2252 | 427 | 94 | 37 | 34 |
| 6 | yes | 0.05% Sterocoll BL<br>0.41% Mowiol 4-98 | 1350 | 255 | 78 | 37 | 29 |

Effective extensional viscosity does not appear to impact on curtain stability (see the results in Table 5). Example 3 shows a high extensional viscosity of 174 mPa·s at 100 000 $s^{-1}$ and Example 4 shows a low extensional viscosity of 4 mPa·s at the same shear rate, yet the minimum flow rate obtained for curtain stability is slightly lower for the latter.

TABLE 5

| Example No. | Effective Extensional Viscosity (mPa · s) at shear rate of 100 000 $s^{-1}$ |
|---|---|
| 1 | 0 |
| 2 | 0 |
| 3 | 174 |
| 4 | 4 |
| 5 | 1 |
| 6 | 150 |

TABLE 6

| Example No. | Qmin (curtain self-forms) ($m^3/(s\cdot m)$) | Web Speed (m/min) | Mix Solids (%) | Dry Coat Weight ($g/m^2$) | Mix Density ($g/cm^3$) | Mix Static Surface Tension (mN/m) | Air Entrainment |
|---|---|---|---|---|---|---|---|
| 1 | $1.80\times10^{-4}$ | 400 | 64.7 | 26.6 | 1.526 | 47 | Yes (≧200 m/min) |
| 2 | $9.26\times10^{-5}$ | 400 | 65.5 | 14.0 | 1.538 | 35 | No |

TABLE 6-continued

| Example No. | Qmin (curtain self-forms) ($m^3/(s \cdot m)$) | Web Speed (m/min) | Mix Solids (%) | Dry Coat Weight ($g/m^2$) | Mix Density ($g/cm^3$) | Mix Static Surface Tension (mN/m) | Air Entrainment |
|---|---|---|---|---|---|---|---|
| 3 | $6.73 \times 10^{-5}$ | 400 | 65.1 | 9.4 | 1.423 | 40 | No |
| 4 | $6.17 \times 10^{-5}$ | 400 | 65.0 | 8.5 | 1.410 | 37 | No |
| 5 | $7.74 \times 10^{-5}$ | 400 | 63.5 | 10.0 | 1.354 | 42 | No |
| 6 | $9.45 \times 10^{-5}$ | 600 | 65.5 | 10.0 | 1.61 | 35.5 | No |

Test Methods

Viscosity—was measured using a Brookfield RVT viscometer. The spindle speed selected was 100 rpm. Spindle size was either sp2 or sp3. The temperature of the mix was recorded during the measurement of viscosity.

Density—was measured using a 100 mL Pycnometer. The temperature was recorded during the measurement of the density.

pH—was measured using an HI 9024 Microcomputer pH meter (Hanna Instruments). The temperature was recorded during the measurement of the pH.

Solids (%)—was measured using a CEM Labwave 9000 Microwave Moisture/Solids Analyzer.

Contact Angle—was measured with a FibroDAT 1100.

Surface Tension—was measured using a DCA 132 apparatus with a platinum plate.

Paper Gloss—was measured using a gloss meter at a fixed angle of 75° (BYK Gardner GmbH).

Paper Smoothness—was measured using a Bekk Smoothness Tester (Messmer Instruments Ltd).

Air Permeability—was measured using a Bendtsen Tester (Lorentzen & Wettre)

Rheology—flow data was measured with a CV0120 High Resolution Rheometer (Bohlin Instruments) using the parallel plate at a gap of 40 μm at 25+/−0.1° C. The shear rate range was 10 to 100 000 $s^{-1}$.

Effective Extensional viscosity—was measured on a Paar Automated High Shear Viscometer HVA 6 with a capillary length of 10 mm and 5 mm and a capillary diameter of 0.6 mm.

Mix Preparation and Coating Method

All parts are expressed in dry weight by 100 parts in dry weight of the total composition.

So, the coating formulas in examples 1-6 are expressed in % dry weight (parts) of the total composition.

All formulations were mixed using a Greaves GM dispersing apparatus. The stirring was optimised to ensure good mixing but to avoid excessive air entrainment The curtain head used was a slide-type with a width of 0.49 m and a die gap of 300 μm. The curtain coating head was equipped with edge guides with running water down each side, with a vacuum suction present to remove this water at the bottom of the edge guides. The catch pan also acts as a baffle—a mechanical barrier to limit air entrainment at the impingement zone. A suction vacuum can optionally be applied (0.3 bar) to reduce the movement across the web of the curtain at the impact zone and to limit further the onset of air entrainment The curtain height was 100 mm.

The coat weight of each coated sample is determined from the known volumetric flow rate of the pump delivering the mix to the curtain head, web speed, density and % solids of the mix, and curtain width. The coat weight is checked by placing a 100 $cm^2$ coated and uncoated substrate sample in an oven at 150° C. for 10 min and measuring the difference in weight between the two samples.

Materials used in Formulations

Calcium carbonate pigments: ground calcium carbonate of which 95% (weight) have an average particle size less than 2.5 μm. Solids at 78%.

Latex binder: an aqueous dispersion of a copolymer of styrene-butadiene. Solids content are at 50%.

Mowiol 40-88 (Kuraray): the polyvinyl alcohol is 88% hydrolysed. The viscosity of a 4% solution at 25° C. is 40 cps as measured on a Brookfield RVT viscometer (manufacturer's data). Used as a rheology modifier (water phase thickener) or as a binder. The polyvinyl alcohol was used as a 10% solution obtained by heating the polyvinyl alcohol granules with water at 95° C. for 0.5 h.

Rheovis 802: an anionic water-in-oil emulsion of a polyacrylamide/acrylate. Used as a rheology modifier (water phase thickener).

Mowiol 4-98 (Kuraray): the polyvinyl alcohol is 98% hydrolysed. The viscosity of a 4% solution at 25° C. is 4.5 cps as measured on a Brookfield RVT viscometer (manufacturer's data). Used as a rheology modifier (thickener) or as a binder. The Mowiol 4-98 was used as a 25% solution obtained by heating the polyvinyl alcohol granules with water at 95° C. for 0.5 h.

The invention claimed is:

1. A curtain coating process for coating substrates with a stable curtain of a uniform coating at low flow rates wherein a free-falling curtain of an aqueous composition comprising a solids content greater than or equal to 50% dry weight is coated onto a moving substrate at a flow rate per unit die length value (Q) equal to or inferior to $10^{-4}$ $m^3/(s \cdot m)$, said aqueous composition comprising a polymeric rheology modifier and a non-ionic surfactant, and wherein the viscosity of the aqueous composition is selected from the group consisting of between 1350 and 2411 mPa·s at a shear rate of 10 $s^{-1}$, between 255 and 438 mPa·s at a shear rate of 100 $s^{-1}$, 50 and 200 mPa·s at a shear rate of 1000 $s^{-1}$, between 25 and 90 mPa·s at a shear rate of 10000 $s^{-1}$, and between 20 and 75 mPa·s at a shear rate of 100000 $s^{-1}$, all at 25° C.

2. The curtain coating process as claimed in claim 1, wherein said rheology modifier is selected from the group consisting of water phase thickeners, associative thickeners, and mixtures thereof.

3. The curtain coating process as claimed in claim 2, wherein said water phase thickeners are selected from the group consisting of anionic polyacrylamide/acrylate polymers, ionic hydrophobic polyether types, polyvinyl alcohol, carboxymethyl cellulose, hydroxyethyl cellulose, starch, proteins and alkali swellable polyacrylate(s).

4. The curtain coating process as claimed in claim 2, wherein said associative thickeners are selected from the group consisting of hydrophobic ethoxylated polyurethanes and polyether polyols.

5. The curtain coating process as claimed in claim 1, wherein said surfactant is selected from the group consisting of alkyl aryl ethoxylates, alkoxylated acetylenics, alkyl acetylenic diols, non-alkoxylated acetylenics, secondary alcohol alkoxylates, and mixtures thereof.

6. The curtain coating process as claimed in claim 1, wherein the static surface tension of the aqueous composition is less than 45 mN/m.

7. The curtain coating process as claimed in claim 1, wherein the aqueous composition comprises binders and pigments.

8. The curtain coating process as claimed in claim 7, wherein the binder is selected from a group consisting of copolymers of styrene, styrene-maleic anhydrides, polyvinyl alcohols, polyvinyl pyrrolidones, carboxymethyl celluloses, starch, protein, polyvinyl acetates, polyurethanes, polyester, acrylic acid and mixtures thereof.

9. The curtain coating process as claimed in claim 7, wherein the pigment is selected from the group consisting of calcium carbonates, aluminium silicate, kaolin, talc, titanium dioxide, silica, aluminas, boehmite alumina, barium sulphate, zinc oxide, plastic pigments, conductive pigments, and mixtures thereof.

10. The curtain coating process as claimed in claim 1, wherein the concentration of rheology modifier in the aqueous composition is less than 5% dry weight of the total composition dry weight.

11. The curtain coating process as claimed in claim 1, wherein the concentration of surfactant in the composition is less than 1% dry weight of the total composition dry weight.

12. The curtain coating process as claimed in claim 1, wherein a dry coat weight coated onto the substrate is less than or equal to 12 $g/m^2$.

13. The curtain coating process as claimed in claim 1, wherein the moving substrate is a fibrous substrate or a plastic substrate.

14. The curtain coating process as claimed in claim 13, wherein the fibrous substrate is a paper or a board.

15. The curtain coating process as claimed in claim 14, wherein the grammage of the paper substrate before coating is less than or equal to 150 $g/m^2$.

16. The curtain coating process as claimed in claim 14, wherein the curtain is coated onto a continuous paper web which is a) non-coated or primed, b) pre-coated or pre-primed, or c) pre-coated and subsequently calendered.

17. The curtain coating process as claimed in claim 13, wherein the moving substrate is a plastic web or a film.

18. The curtain coating process as claimed in claim 1, wherein the free-falling curtain comprises one or more layers.

19. The curtain coating process as claimed in claim 18, wherein said free-falling curtain comprises two layers of aqueous composition with a solids content greater than or equal to 50% dry weight.

20. The curtain coating process as claimed in claim 1, wherein the aqueous composition has an effective extensional viscosity greater than 0 mPa·s at a shear rate of 100000 $s^{-1}$.

21. The curtain coating process as claimed in claim 1, wherein the speed of the moving substrate is between 400 and 600 m/min.

22. A curtain coating process for coating substrates with a stable curtain of a uniform coating at low flow rates wherein a free-falling curtain of an aqueous composition comprising a solids content greater than or equal to 50% dry weight is coated onto a moving substrate at a flow rate per unit die length value (Q) equal to or inferior to $10^{-4}$ $m^3/(s \cdot m)$, said aqueous composition having said solids content comprising a polymeric rheology modifier and a non-ionic surfactant, wherein the viscosity of the aqueous composition is selected from the group consisting of between 50 and 200 mPa·s at a shear rate of 1000 $s^{-1}$, between 25 and 90 mPa·s at a shear rate of 10000 $s^{-1}$, and between 20 and 75 mPa·s at a shear rate of 100000 $s^{-1}$, all at 25° C., and wherein the aqueous composition has an effective extensional viscosity greater than 0 mPa·s at a shear rate of 100000 $s^{-1}$.

* * * * *